United States Patent [19]

Kraft

[11] Patent Number: 4,717,362

[45] Date of Patent: Jan. 5, 1988

[54] LIFESAVING CRAFT

[76] Inventor: Urban Kraft, Stenhuggarvägen 3D, Bollnäs, Sweden

[21] Appl. No.: 822,302

[22] PCT Filed: Mar. 29, 1985

[86] PCT No.: PCT/SE85/00142

§ 371 Date: Jan. 13, 1986

§ 102(e) Date: Jan. 13, 1986

[87] PCT Pub. No.: WO85/05340

PCT Pub. Date: Dec. 5, 1985

[30] Foreign Application Priority Data

May 16, 1984 [SE] Sweden ..... 8402637-6

[51] Int. Cl.[4] ..... B63C 9/32

[52] U.S. Cl. ..... 441/82; 280/18

[58] Field of Search ..... 441/80, 35, 129, 128; 114/43; 5/87 R, 87 B; 280/18, 19

[56] References Cited

U.S. PATENT DOCUMENTS

| | | | |
|---|---|---|---|
| D. 255,820 | 7/1980 | Borden et al. | 280/18 |
| 981,360 | 1/1911 | Barney | 441/65 |
| 3,453,000 | 7/1969 | Asher | 280/18 |
| 3,532,066 | 1/1973 | Cleman | 114/43 |
| 3,711,879 | 10/1970 | Siefert | 441/82 |
| 3,775,782 | 12/1973 | Rice et al. | 441/129 |
| 4,079,953 | 3/1978 | Howarth | 441/82 |
| 4,179,764 | 12/1979 | Lindblade | 114/43 |

FOREIGN PATENT DOCUMENTS

| | | | |
|---|---|---|---|
| 2359962 | 11/1975 | Fed. Rep. of Germany | 114/43 |
| 2114066 | 8/1983 | United Kingdom | 441/80 |

*Primary Examiner*—Jeffrey V. Nase
*Assistant Examiner*—Jesûs D. Sotelo
*Attorney, Agent, or Firm*—Larson and Taylor

[57] ABSTRACT

A lifesaving craft comprises a flat-bottomed elongate buoyant structure 91) which on its lower side is free from projections and on its upper side has a number of grab means (5, 17, 20) and means for keeping a person in distress on the craft. At least at one of its two opposite ends (11, 12) the craft has to projections (13, 13') extending in prolongation of the sides of the craft, between which projections a preferably gently curved recess (14) is provided to receive and center the person in distress when he is taken up on the craft.

4 Claims, 13 Drawing Figures

LIFESAVING CRAFT

BACKGROUND OF THE INVENTION

The invention relates to a lifesaving craft comprising a flat-bottomed elongate buoyant structure which on its upper side has a number of grab means and means for keeping a person in distress on the buoyant structure.

BRIEF DESCRIPTION OF THE INVENTION

A lifesaving craft of the above type is disclosed in SE patent application No. 8306096-2. It is the object of the present invention to develop further the craft described in said application in order to optimise the properties thereof. To this end, the present invention proposes a buoyant structure which is characterised in that it has, at least at one of its two opposite ends, two projections extending along or in prolongation of the sides of said buoyant structure and, between said projections, a preferably gently curved recess adapted to receive and center the person in distress when he is pulled up on the craft, at least the lower side of each projection being inclined outwards and upwards to facilitate moving the craft forward.

BRIEF DESCRIPTION OF THE ACCOMPANYING DRAWNGS

In the drawings:

FIG. 1 is a perspective view illustrating the upper side of the craft according to the invention, FIG. 2 is a perspective view illustrating the underside of the said craft; and FIGS. 3–13 are simplified lateral views illustrating different stages of a rescue operation with the craft according to the invention.

DETAILED DESCRIPTION OF A PREFERRED FURTHER DEVELOPMENT OF THE INVENTION

Figure 1:
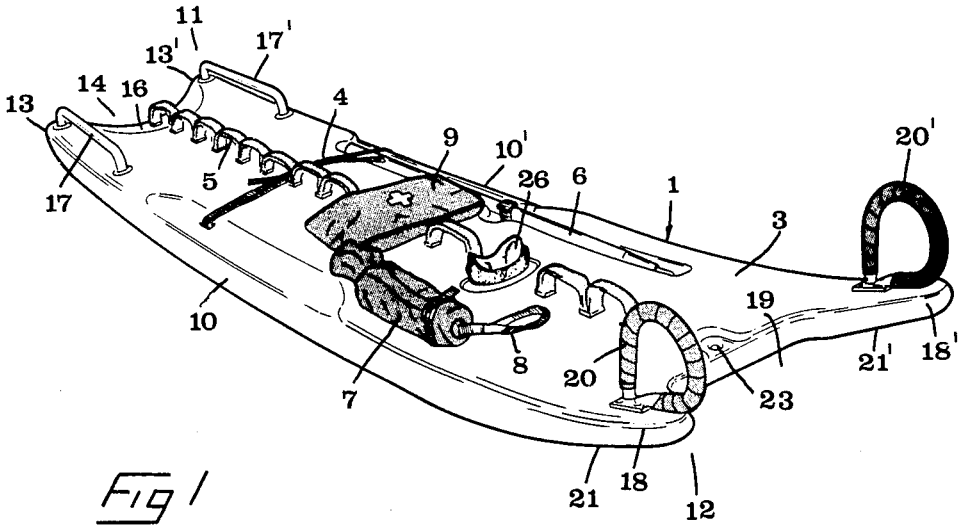
Figure 2:
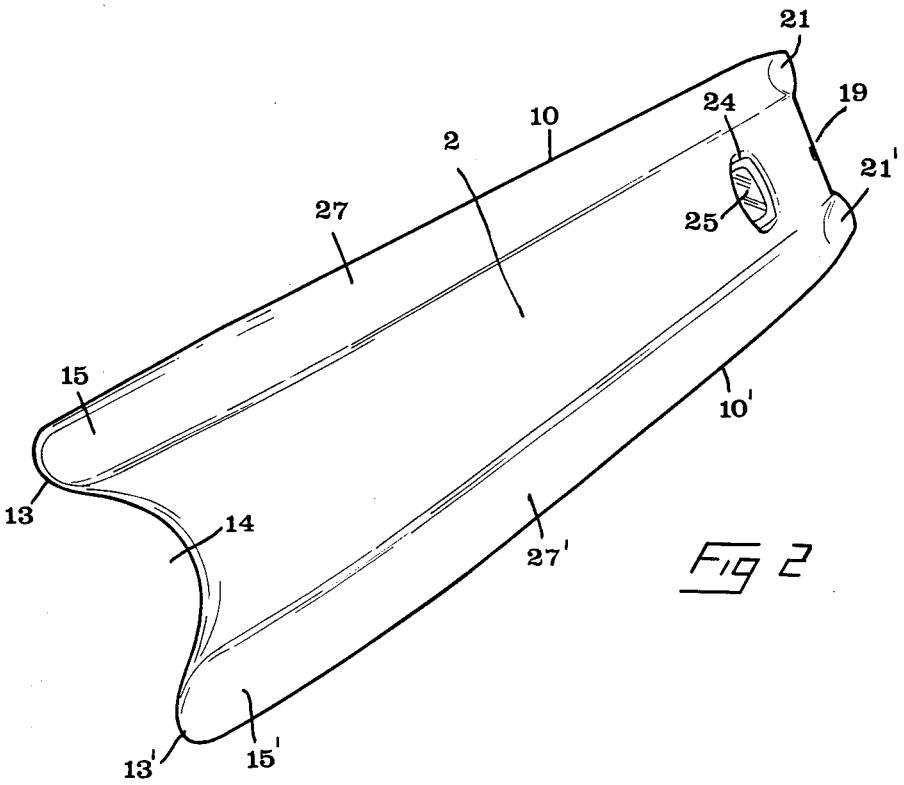

The craft shown in FIGS. 1 and 2 comprises a buoyant structure generally designated 1, the lower side 2 of which is substantially smooth or free from projections and the upper side of which is equipped with a number of details which have been described already in SE patent application No. 8306096-2, i.e. a belt 4 for fastening a person in distress and a number of flexible grab means 5 to be grabbed by both the person in distress and the rescuer if necessary. Furthermore, the craft comprises an ice-stick 6 held in a recess, a bag 7 with an extra lifeline 8 which is easily accessible, and a bag 9 with further lifesaving equipment, for example a warming blanket or cloth.

As will appear from FIGS. 1–2 in combination with FIGS. 3–13, the buoyant structure 1 is substantially flat along the major part of its length and has two substantially parallel longitudinal edges 10, 10′ and two opposite ends 11 and 12, the first one being the fore or front end and the other the aft or rear end. In actual practice, the buoyant structure 1 preferably consists of a cellular plastic core which is provided with a thin shell of impact-resistant plastic of suitable type. The buoyant structure proper may preferably have a volume of 200–300 liters and a weight of 20–30 kilos.

According to the invention, the buoyant structure 1 is formed at its front end 11 with two forwardly extending projections 13, 13′ between which a preferably gently curved recess 14 is provided to receive and center the person in distress when he is pulled up on the upper side of the buoyant structure. The lower sides 15, 15′ of these projections 13, 13′ are inclined in a forward-upward direction to facilitate moving the craft forward, especially up on an ice edge, and at the same time the upper side 16 of the buoyant structure portion adjacent the recess 14 is inclined in the opposite direction, i.e. forward-downward, to facilitate pulling the person in distress up on the craft. In the vicinity of the longitudinal edges 10, 10′, a pair of fairly long handles 17, 17′ are mounted in direct connection with the projections 13, 13′. The length of the handles 17 may be 0.5–1.0 meter.

Also the aft end 12 of the buoyant structure is formed with two projections 18, 18′ between which a recess 19 is defined, and two handles 20, 20′ are mounted in connection with the two projections. The provision of the handles 17, 17′; 20, 20′ in combination with the two recesses 14, 19 also makes it possible to use the craft as a stretcher, in which case two bearers may grasp the handles and carry the craft quite comfortably, the recesses 14, 19 providing ample room for the bearers' legs. It should be noted that the two handles 20, 20′ are substantially circular with a relatively large diameter, thus ensuring that a rescuer can conveniently grasp the handles at different points along their length to enable him to take a firm and comfortable hold, regardless of the angle position at which the craft is carried.

It should also be noted that the lower sides 21, 21′ of the projections 18, 18′ are inclined relatively to the plane of the craft's bottom, that is to say in an upward-rearward direction.

Figure 3:
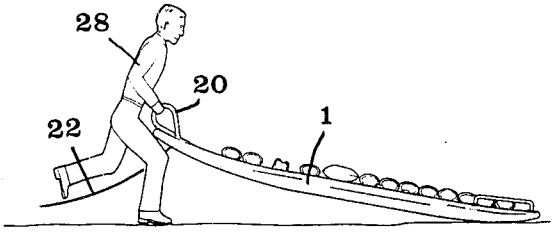

In the area of the aft end, a means is provided for attaching a towing rope 22 (see FIG. 3). In the embodiment shown, this means is a through hole 23 through the buoyant structure proper, although other means may also be used, for example eyelets or rings.

Furthermore, the aft half of the buoyant structure has a fairly large through opening 24 in which a transparent disc 25 is mounted to serve as an observation window. For this purpose, there is mounted along the upper edge of the opening 24 a rubber collar 26 which closely fits the face of a rescuer to give him an excellent view, through the observation window 25, into the underlying body of water when searching for sunken persons.

As appears from FIG. 2, the bottom side of the buoyant structure has two longitudinal, comparatively wide runner-type beads 27, 27′ located along the longitudinal sides of the craft. These beads increase the rigidity of the craft and, to some extent, also have a steering effect when moving the craft on ice and/or snow.

Figure 4:
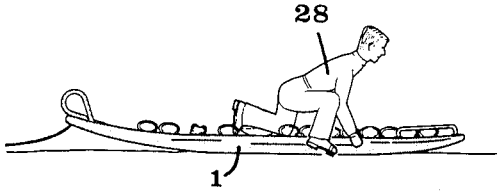
Figure 5:
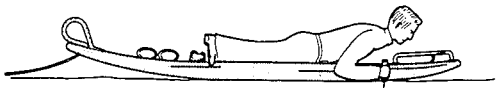
Figure 6:
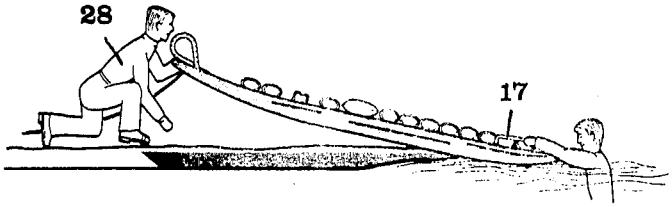
Figure 7:
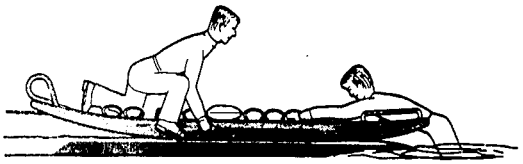
Figure 8:
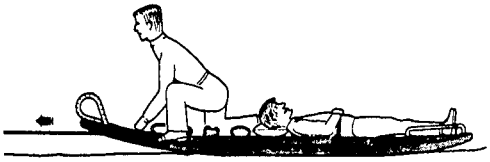
Figure 9:
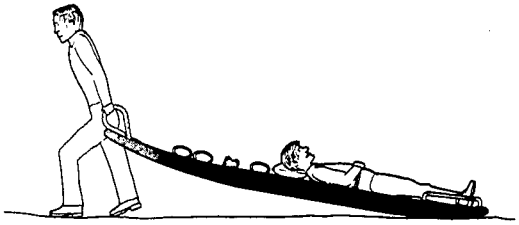
Figure 10:
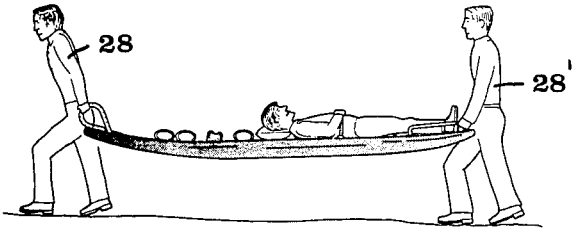
Figure 11:
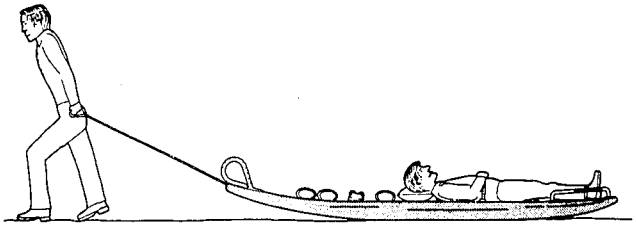

Reference is now made to FIGS. 3–13 which schematically illustrate different stages of a rescue operation with the craft according to the invention. In FIG. 3, it is thus illustrated how a rescuer 28 by means of the handles 20, 20′ can support the aft end of the craft and move it toward the person in distress. The coiled-up towing rope 22 has been made fast on land and trails after the craft. In the embodiment according to FIG. 3, it is assumed that the rescuer is on firm ground or bearing ice. FIG. 4 shows how the rescuer, on less bearing ice, can kneel on the craft and move it forward with one leg. In FIG. 5 it is assumed that the ice is very weak, the rescuer moving the craft forward by means of his hands, optionally with the aid of ice-prods. In FIG. 6, the rescuer and the craft have reached the person in distress, who can now grab the handles 17 and pull himself on to the craft, as also shown in FIG. 7, provided he is conscious. The pulling-up operation is greatly facilitated by the two projections 13, 13' in combination with the surface 16 extending upwards and rearwards since the two projections automatically center the person in distress and prevent him from falling over the side. This centering effect which is further increased by the two handles 17, 17', is especially important when the person in distress is unconscious or so weak that the rescuer 28 must, on his own, pull up the person in distress on the craft. Once the person in distress has got on the craft, he is fastened by the belt 4, and then both the person in distress and the rescuer are pulled back to the shore in the manner as described in SE patent application No. 8306096-2 and shown in FIG. 8. Furthermore, only one rescuer is needed to pull the craft behind himself in the manner shown in FIG. 9. As will appear from FIG. 10, the craft may also be used as a stretcher, the two bearers 28, 28' carrying the craft at each end by means of the two pairs of handles 17, 17' and 20, 20'. The rescuer can also pull the craft behind himself by a towing rope 29, as shown in FIG. 11.

Figure 12:
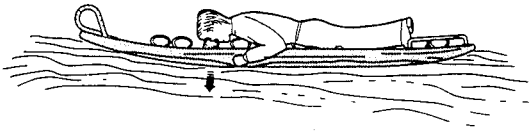
Figure 13:
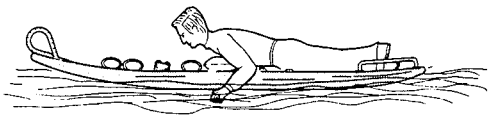

FIGS. 12 and 13 illustrate how the craft can also be used on icefree water, especially when searching for a sunken person, in which case the rescuer can move the craft forward by using his hands as paddles and simultaneously searching the water underneath through the observation window 25.

I claim:

1. An ice rescue craft comprising;

a bouyant structure which has a length substantially greater than its width so as to accommodate both the person in distress and a rescuer, the bottom of the structure being generally flat, at least one end of the structure having two projections, each being a prolongation of one of the sides of the structure, at least one grab means located on top of each said projection, positioned to be grabbed by a person in distress, said at least one end, between said projections, when viewed from above being in the shape of a shallow curved recess which comprises a means for receiving and centering a person in distress as that person is pulled onto the craft, at least the bottom of each said projection being inclined upward in the direction toward the outermost end of that projection to constitute a means for facilitating movement of the craft up on an ice edge, the upper side of the buoyant structure adjacent said shallow curved recess being inclined outwardly and downwardly toward the edge of said recess to constitute a means for facilitating pulling the person in distress up onto the craft, and the end opposite from said one end having grasping means for the rescuer to grasp the craft.

2. An ice rescue craft according to claim 1, said grab means including an upraised handle extending generally parallel to the sides of the structure.

3. An ice rescue craft according to claim 2, said grasping means comprising a second pair of handles located along the sides of the craft at the end thereof opposite from said at least one end and being substantially circular for conveniently holding the craft at that end regardless of the angle of inclination at which the craft is carried.

4. An ice rescue craft according to claim 1, wherein the generally flat bottom of the structure comprises two runner beads located from front to back along opposite sides of the structure.

* * * * *